US005909811A

United States Patent [19]

Harris

[11] Patent Number: 5,909,811

[45] Date of Patent: Jun. 8, 1999

[54] HOLDER FOR A BOTTLE OF A COSMETIC

[76] Inventor: Carlene B. Harris, 1048 Shaffer Trail, Oviedo, Fla. 32765

[21] Appl. No.: 08/962,621

[22] Filed: Nov. 3, 1997

[51] Int. Cl.[6] ..... B65D 69/00; A47G 23/02

[52] U.S. Cl. ..... 206/581; 206/457; 248/146; 248/310; 248/910

[58] Field of Search ..... 248/102, 105, 248/106, 133, 146, 152, 310, 910; 229/89, 91; 206/581, 457; 215/11.6, 12.1, 395

[56] References Cited

U.S. PATENT DOCUMENTS

| | | | |
|---|---|---|---|
| D. 160,155 | 9/1950 | Flamand . | |
| D. 252,828 | 9/1979 | Davidson . | |
| D. 279,141 | 6/1985 | Poland . | |
| D. 280,570 | 9/1985 | Stanley et al. . | |
| 387,466 | 8/1888 | Watson | 206/457 X |
| 1,171,210 | 2/1916 | Keffer | 215/395 X |
| 1,281,025 | 10/1918 | Klein . | |
| 1,559,210 | 10/1925 | Wetherell . | |
| 2,000,302 | 5/1935 | Solomon | 206/581 X |
| 2,134,746 | 11/1938 | Allen | 248/102 |
| 2,219,974 | 10/1940 | Bellow . | |
| 2,364,814 | 12/1944 | Plummer et al. . | |
| 2,409,820 | 10/1946 | Zimmern | 215/12.1 |
| 2,916,184 | 12/1959 | Hartley et al. . | |
| 2,979,990 | 4/1961 | Alexander . | |
| 3,029,058 | 4/1962 | Himler | 248/133 |
| 3,109,537 | 11/1963 | Larkin . | |
| 3,125,145 | 3/1964 | Williams . | |
| 3,278,008 | 10/1966 | Larkin . | |
| 3,804,233 | 4/1974 | Gregg, Jr. . | |
| 3,885,578 | 5/1975 | Hicks . | |
| 4,192,329 | 3/1980 | Swearingen . | |
| 4,398,643 | 8/1983 | Conlon | 248/910 X |
| 4,462,444 | 7/1984 | Larson . | |
| 4,733,808 | 3/1988 | Turner, Jr. et al. . | |
| 4,736,876 | 4/1988 | Kriss . | |
| 4,795,117 | 1/1989 | Siteman | 248/146 |
| 4,821,932 | 4/1989 | Petryshyn . | |
| 5,743,500 | 4/1998 | Northway et al. | 248/146 |

*Primary Examiner*—Bryon P. Gehman
*Attorney, Agent, or Firm*—Quarles & Brady

[57] ABSTRACT

A holder for a bottle containing a cosmetic, such as nail polish, has a sack-like base portion which contains small particles. An annular container is attached to the mid section of the base portion for removably receiving the bottle. During application of the cosmetic, the ends of the base portion are draped over an arm of leg of the user with the particles providing weight to retain the holder in place. When not being used, the base portion is wrapped around the bottle and the ends of the base portion are fastened together to retain the bottle therein.

16 Claims, 1 Drawing Sheet

HOLDER FOR A BOTTLE OF A COSMETIC

BACKGROUND OF THE INVENTION

The present invention relates to holders for supporting a bottle containing a cosmetic while the user is applying the cosmetic; and more particularly to such holders which are adapted to hold the bottle of cosmetic against a leg or arm of the user.

Nail polish and other cosmetics come in bottles with a screw-on top that contains an integral brush for applying the cosmetic material. The user unscrews the top and uses the brush to apply the cosmetic to a specific anatomical feature, for example polish is applied by the brush to the nails of the user's hand or foot. The user periodically inserts the brush into the bottle so that the brush can carry the cosmetic from the bottle to the anatomical feature being treated. The bottle typically is placed on a table or other support while the brush is being used. However, there are times when the individual desires to apply the cosmetic in a location in which a table top or other stable, flat support surface for the bottle is not available.

SUMMARY OF THE INVENTION

A general object of the present invention is to provide a holder for a bottle of a cosmetic which the holder can be draped over the leg or arm of the user to support the bottle during the cosmetic application. This facilitates cosmetic use in areas without a table top or other support surface for the bottle.

Another object is to provide a cosmetic bottle holder which is weighted to inhibit the holder and cosmetic bottle from sliding off of the arm or leg of the user.

A further object of the present invention is to enable the cosmetic bottle holder to be wrapped around the bottle and secured in place when not in use.

These and other objectives are satisfied by a cosmetic bottle holder that includes a base portion having an elongated flexible sack, divided into first and second end sections with a midsection therebetween. The first and second end sections contain particles which act as weights. A container is attached to the midsection of the sack for removably receiving the bottle containing the cosmetic.

The flexible nature of the base portion allows it to be draped over and conform to the shape of the leg or arm of the user. The particles add weight to the end sections thereby retaining the bottle holder in place.

In the preferred embodiment, a fastener is provided to releasably attach the first and second end sections together when wrapped around the bottle for storage.

DETAILED DESCRIPTION OF THE INVENTION

Figure 1:
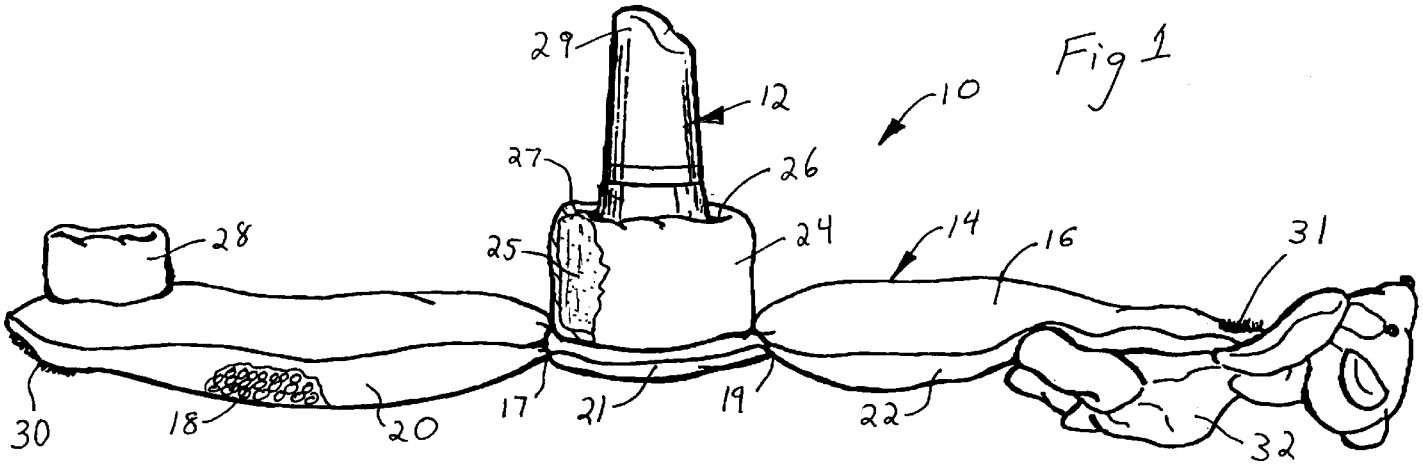
FIG. 1 is a side view of a cosmetic bottle holder according to the present invention.

With initial reference to FIG. 1, a holder 10 for a cosmetic bottle 12. The holder has a base portion 14 of flexible material, such as plastic, cloth or other fabric, that is sewn together to form a closed elongated sack 16. The sack 16 is divided by seams 17 and 19 into first and second end sections 20 and 22 with a midsection 21 therebetween. The end sections 20 and 22 are filled with particles 18, which preferably are small beads but which may comprise pellets, sand, stones, metal spheres, beans, or other particles that add weight to the end sections while enabling the base portion 14 to remain flexible and conform to a person's leg or arm, as will be described.

A container 24 is attached to the mid section 21 of the base portion 14. Preferably the container 24 comprises a strip of foam rubber 25, or other resilient yet supportive material, enclosed by an outer fabric covering 27 with the combination bent into a loop that is sewn together and to the sack 16 of the base portion 14. The annular container 24 has a central opening 26 within which the bottom of the nail polish bottle 12 is received. The size of the opening 26 approximates the outer diameter of the typical nail polish bottle so that the bottle is snugly held within the container 24.

Figure 2:
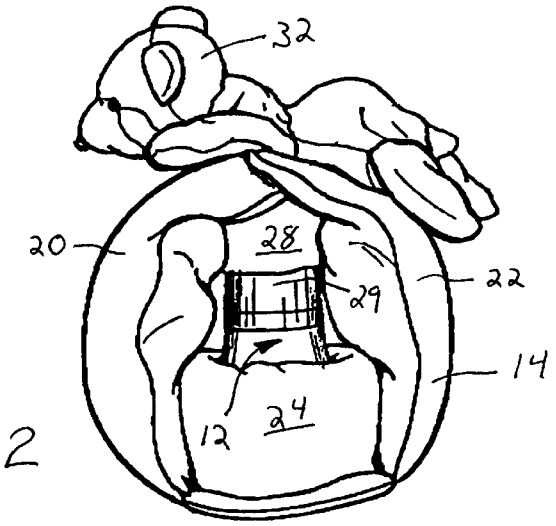
FIG. 2 illustrates the cosmetic bottle holder in a closed, or storage state.

When a nail polish bottle 12 is not being used the holder 10 is wrapped around the bottle as shown in FIG. 2. For this purpose, an annular retainer 28 is attached to one side of the sack's first end section end 20 which when wrapped around the bottle 12, the bottle cap 29 fits into the opening of the annular retainer 28. The retainer 28 has a similar construction to that of the container 24, albeit typically a smaller diameter to accommodate the smaller outer diameter of the bottle cap 29. Specifically, the retainer 28 is constructed of another strip of foam rubber or other resilient material enclosed in a fabric covering and connected in a loop which is sewn to the base portion 14.

The base portion 16 has fasteners 30 and 31 attached thereto for securing the first and second end sections 20 and 22 together when the base portion is wrapped around the bottle 12 as shown in FIG. 2. Preferably, the fasteners 30 and 31 comprise hook and loop materials, although other types of mating fasteners may be employed.

A fabric caricature 32 of an animal is sewn to the second end section 22 of the base portion 14 to provide not only a decorative appearance to that end, but also a handle by which the user can grasp the holder 10 for carrying the cosmetic bottle in the closed state. Alternatively, facial features and ears of the animal can applied directly to the second end section 22 instead of using a separate animal caricature. Furthermore, one skilled in the art will appreciate that other caricatures, such as an angel and a cartoon character, or another object, such as a flower, may be depicted at the second end section 22 of the base portion 14.

Figure 3:
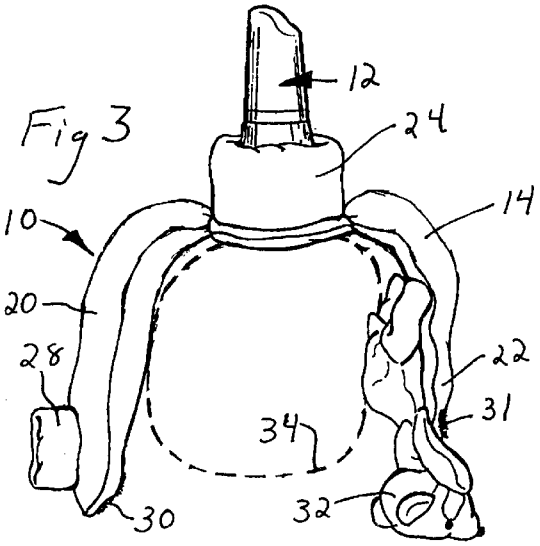
FIG. 3 depicts the cosmetic bottle holder draped around a leg or arm of a user.

When using the bottle 12 of the cosmetic, the first and second end sections 20 and 22 of the base portion are detached from each other and draped over and conform to the shape of a user's leg or arm indicated by dashed lines 34 in FIG. 3. In this opened state of the holder 10, the weighted particles 18 within the sack of the base portion 14 fall toward the first and second ends 20 and 22 which extend downward from the midsection 21 when draped around the arm or leg 34. The particles weight down the holder 10 keeping it centered on the arm or leg 34 so that the nail polish bottle 12 does not tip over.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. For example, the present invention may be used with a variety of different types of containers for cosmetics. Accordingly, the scope of the invention should be determined from the following claims and not limited by the above disclosure.

I claim:

1. An article for holding a bottle containing a cosmetic, said article comprising:

a base portion including an elongated flexible sack which is divided into first and second end sections with a midsection therebetween, and the base portion further including weights inside the first and second end sections;

a container attached to the midsection of the elongated flexible sack for removably receiving the bottle containing the cosmetic; and a retainer attached to the first end section of the base portion for removably receiving the bottle containing the cosmetic.

2. The article as recited in claim 1 wherein the weights comprise a plurality of particles selected from a group consisting of pellets, sand, stones, metal spheres, beans and beads.

3. The article as recited in claim 1 further comprising a fastener for attaching the first end section to the second end section.

4. The article as recited in claim 3 wherein the fastener comprises hook and loop materials.

5. The article as recited in claim 1 wherein the container comprises a ring having an opening for receiving the bottle containing the cosmetic.

6. The article as recited in claim 1 wherein the container comprises a ring having resilient foam material within a fabric covering which is attached to the base portion.

7. The article as recited in claim 1 wherein the retainer comprises a resilient ring having a fabric covering which is attached to the base portion.

8. The article as recited in claim 1 wherein the second end section of the sack is shaped to depict a face of an animal.

9. The article as recited in claim 1 wherein the second end section of the sack has an object attached thereto which is selected from the group consisting of an angel, an animal, a cartoon character and a flower.

10. An article for holding a bottle of nail polish, said article comprising:

a base portion including an elongated flexible sack containing particles, and having first and second end sections;

a container attached to the base portion for removably receiving the bottle of nail polish;

a fastener for attaching the first end section to the second end section;

a retainer attached to the first end section of the base portion for removably receiving the bottle containing the cosmetic; and wherein the article has a storage position in which the base portion is wrapped around the bottle of nail polish with the fastener securing the first and second end sections together, and a usage position in which the first and second end sections of the base portion are detached from each other extending downwardly from the container.

11. The article as recited in claim 10 wherein the particles are selected from a group consisting of pellets, sand, stones, metal spheres, beans and beads.

12. The article as recited in claim 10 wherein the container comprises a ring having an opening for receiving the bottle containing the cosmetic.

13. The article as recited in claim 10 wherein the container comprises a ring having resilient foam material within a fabric covering which is attached to the base portion.

14. The article as recited in claim 10 wherein the retainer comprises a resilient ring having a fabric covering which is attached to the base portion.

15. The article as recited in claim 10 wherein the second end section of the sack has a shape depicting a face of an animal.

16. The article as recited in claim 10 wherein the second end section of the sack has an object attached thereto which is selected from the group consisting of an angel, an animal, a cartoon character and a flower.

* * * * *